US006161405A

United States Patent [19]

Anbe et al.

[11] Patent Number: 6,161,405

[45] Date of Patent: Dec. 19, 2000

[54] APPARATUS FOR CONTROLLING A ROLLING MILL BASED ON A STRIP CROWN OF A STRIP AND THE SAME

[75] Inventors: Yoshiharu Anbe; Tomoyuki Tezuka, both of Tokyo, Japan

[73] Assignee: Kabushiki Kaisha Toshiba, Kawasaki, Japan

[21] Appl. No.: 09/357,650

[22] Filed: Jul. 20, 1999

[30] Foreign Application Priority Data

Jul. 21, 1998 [JP] Japan ..... 10-204933

[51] Int. Cl.[7] ..... B21B 37/28

[52] U.S. Cl. ..... 72/9.1; 72/11.7

[58] Field of Search ..... 72/8.3, 8.9, 9.1, 72/9.2, 11.2, 11.6, 11.7, 11.8, 12.7

[56] References Cited

U.S. PATENT DOCUMENTS

| | | | |
|---|---|---|---|
| 4,805,492 | 2/1989 | Tsuruda | 72/9.1 |
| 5,126,947 | 6/1992 | Koyama | 72/9.1 |
| 5,493,885 | 2/1996 | Nomura et al. . | |
| 5,860,304 | 1/1999 | Anbe et al. . | |
| 5,927,117 | 6/1999 | Zhang | 72/9.1 |
| 5,960,657 | 10/1999 | Anbe et al. | 72/9.1 |

*Primary Examiner*—Ed Tolan

*Attorney, Agent, or Firm*—Oblon, Spivak, McClelland, Maier & Neustadt, P.C.

[57] ABSTRACT

A rolling mill is equipped with a work roll bending apparatus for controlling the strip crown of the strip. Upstream and downstream of the rolling mill are located strip crown meters which measure the thickness of the strip in the transverse direction. The variables of the work roll bending apparatus are manipulated, and determining the inheritance coefficient is determined on the basis of measurement values of the strip crown of the strip measured by the strip crown meters.

9 Claims, 2 Drawing Sheets

APPARATUS FOR CONTROLLING A ROLLING MILL BASED ON A STRIP CROWN OF A STRIP AND THE SAME

BACKGROUND OF THE INVENTION

1. Field of the Invention

The present invention relates to the rolling of metal and other strip, and more particularly relates to an apparatus for measuring and determining the inheritance coefficient of the crown of the strip.

2. Description of the Related Art

The inheritance coefficient of the crown in strip rolling has hitherto been determined from the results of simulation based on theoretical expressions, and no attempt has been made to devise a method or apparatus for determining the inheritance coefficient on the basis of actual data.

The strip crown is one of the most important indices to indicate the quality of product. Recently in many cases, the strip crown is corrected to a desired value by rolling mills equipped with an apparatus which allows that to be controlled. It is usual for the initial settings of this apparatus for controlling the strip crown to be based on pass schedule or similar data, and the control is achieved by changing the variables of the apparatus on the basis of the measured value. Influence coefficients or inheritance coefficients are used for the initial settings and the control mentioned above. As has already been explained, the inheritance coefficients adopted hitherto have been determined through simulation. These are very different from the true inheritance coefficients. As a result, the strip crown is not controlled to the desired value.

SUMMARY OF THE INVENTION

Accordingly, one object of the present invention is to provide a novel apparatus for measuring and determining inheritance coefficients in rolling, whereby the inheritance coefficient is determined on the basis of data collected during rolling with a view to improving strip crown control.

The abovementioned object of the present invention is achieved by means of an apparatus for controlling a rolling mill based on a strip crown of a strip, comprising:

strip crown meter for measuring the strip crown on an entry side and a delivery side of the rolling mill: and determination means for changing variables to control the strip crown, and determining inheritance coefficients of the strip crown based on the variables before and after changing and the measured values by the strip crown meter before and after changing the variables.

The above-mentioned object of the present invention is also achieved by means of an apparatus for controlling a continuous rolling mill system having two or more rolling mill based on a strip crown of a strip, comprising:

strip crown meter for measuring the strip crown on an entry side and a delivery side of the rolling mill: and determination means for changing variables to control the strip crown, and determining inheritance coefficients of the strip crown based on the variables before and after changing and the measured values by the strip crown meter before and after changing the variables.

BRIEF DESCRIPTION OF THE DRAWINGS

A more complete appreciation of the present invention and many of the attendant advantages thereof will readily be obtained as the same becomes better understood by reference to the following detailed description when considered in connection with the accompanying drawings, wherein.

DETAILED DESCRIPTION OF THE PREFERRED EMBODIMENTS

Figure 1:
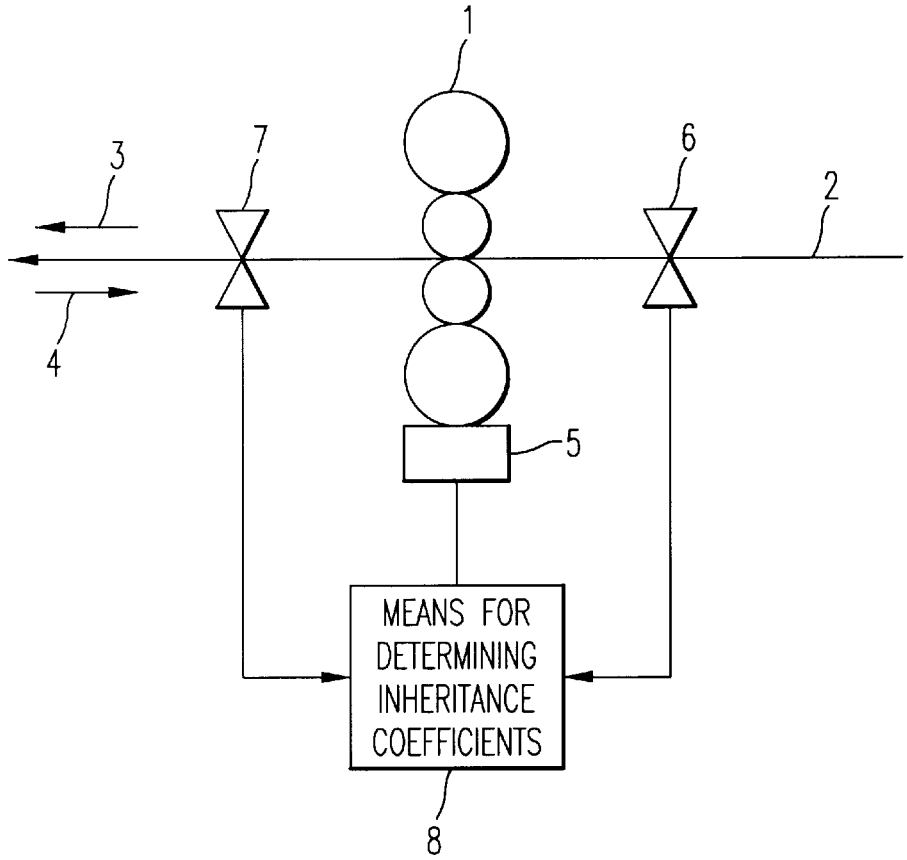
FIG. 1 is a drawing illustrating the outline configuration of a first embodiment of the present invention to which the invention pertains, along with the rolling mill to which it is applied.

With reference now to the drawings, wherein like reference numerals designate identical or corresponding parts throughout the several views, and particularly to FIG. 1, a first embodiment of the present invention will be described.

FIG. 1 is a schematic drawing illustrating the configuration of a first embodiment of the present invention pertains, along with a single-stand rolling mill to which it is applied. The rolling mill 1 rolls the strip 2, and it is normal for a single-stand rolling mill of this sort to be capable of rolling in the direction of both the arrow 3 and the arrow 4. The desired strip thickness is obtained by rolling n times. (These will be referred to hereinafter as n passes.) The rolling mill 1 is equipped with a work roll bending apparatus 5, which serves to control the crown of the strip 2. Upstream and downstream of the rolling mill 1 are located strip crown meters 6, 7, which measure the strip thickness in the transverse direction. Means of determining inheritance coefficients 8 manipulates the variables of the work roll bending apparatus 5, and determines the inheritance coefficients on the basis of the measurement values of the crown of the strip 2 as measured by the strip crown meters 6, 7.

Figure 2:
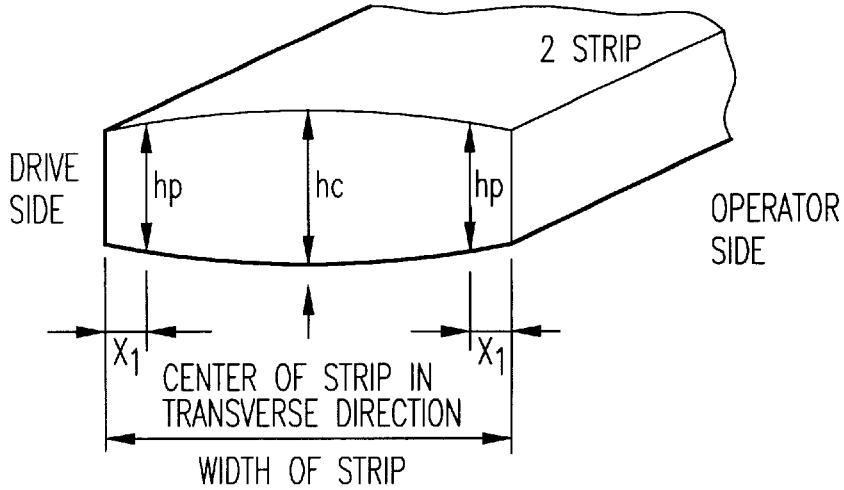
FIG. 2 is a drawing illustrating a strip crown.

By inheritance coefficients is meant the degree to which the crown of the strip 2 on the entry side of the rolling mill 1 affects the crown of the strip 2 on the delivery side of the rolling mill 1. Strip crown and inheritance coefficient are defined in the following manner. As may be seen from FIG. 2, the strip crown C is normally represented as $$c = \frac{h_c - \frac{h_D + h_P}{2}}{h_c} \tag{1}$$

where $h_C$ is the thickness of the strip 2 at the center in the transverse direction, $h_D$ is its thickness at a position X1 from the end on the drive side, and $h_P$ is its thickness at a position X1 from the end on the operator side. The distance X1 from the head end of the strip is often a value such as 10, 25, 40 (mm), but any value will do.

In FIG. 1, the number of passes is 1, 2, . . . , j, j+1, . . . , n

In this case, the inheritance coefficient $\eta_{j+1}$ at (j+1) passes is $$\eta_{j+1} = \frac{\partial C_{j+1}}{\partial C_j} \tag{2}$$

There follows an explanation of the action of the first embodiment. There are two methods of determining the inheritance coefficient in FIG. 1, namely at the first pass and at the second pass.

First of all, the method whereby the inheritance coefficient is determined at the first pass will be described. The relationship between the variable amount of the work roll bending apparatus and the strip crown is represented by the following formula.

$$\Delta C_{j+1} = \frac{\partial C_{j+1}}{\partial C_j} \cdot \Delta C_j + \frac{\partial C_{j+1}}{\partial F_{j+1}} \cdot \Delta F_{j+1} \tag{3}$$

where $\Delta C_{j+1}$: Amount of change of the strip crown on the delivery side of the rolling mill at pass (j+1)

$\partial C_{j+1}/\partial C_j$: Inheritance coefficient at pass (j+1) ($=\eta_{j+1}$)

$\Delta C_j$: Amount of change of the strip crown on the entry side of the rolling mill at pass (j+1)

$\partial C_{j+1}/\partial F_{j+1}$: Influence coefficient on the strip crown in relation to the variables of the work roll bending apparatus at pass (j+1)

$\Delta F_{j+1}$: Amount of change to the variables of the work roll bending apparatus at pass (j+1)

Expression (3) allows the inheritance coefficient to be determined provided that the amount of change of the crown of the strip 2 at the entry and delivery sides of the rolling mill 1 is measured, along with the amount of change to the variables of the work roll bending apparatus 5.

During the course of pass (j+1), the means of determining inheritance coefficients 8 changes the variables of the work roll bending apparatus 5 by $\Delta F_{j+1}$. Meanwhile, the crown of the strip 2 entering the rolling mill usually also varies, and these are measured by the strip crown meter 6 (during rolling in the forward direction; the strip crown meter 7 during rolling in the reverse direction) located on the entry side of the rolling mill 1. The means of determining inheritance coefficients 8 determines the amount of change $\Delta C_j$ of the crown of the strip 2 on the basis of this measurement value. Similarly, the strip crown meter 7 (during rolling in the forward direction; the strip crown meter 6 during rolling in the reverse direction) located on the delivery side of the rolling mill 1 measures the crown of the strip 2 after rolling. On the basis of this measurement value, the means of determining inheritance coefficients 8 determines the amount of change $\Delta C_{j+1}$ of the crown of the strip 2. In this manner, the amount of change of the crown of the strip 2 at the entry and delivery sides of the rolling mill 1 is established, along with the amount of change to the variables of the work roll bending apparatus 5. Thus, if the variables of the work roll bending apparatus 5 are modified at least twice, the means of determining inheritance coefficients 8 is able to determine the inheritance coefficient $\eta_{j+1}$ by regression from expression (3).

However, the crown of the strip on the entry side of the rolling mill 1 is controlled by the number of previous passes, and is frequently very small. This may lead to inaccuracies when the inheritance coefficient is determined from expression (3).

Next, the method whereby the inheritance coefficient is determined at the second pass will be described. In this case, the means of determining inheritance coefficients 8 manipulates the work roll bending apparatus 5 during the course of pass j. The crown of the strip 2 on the delivery side of the rolling mill 1 is measured by the strip crown meter 6 if pass j is in the forward direction, and by the strip crown meter 7 if it is in the reverse direction. On the basis of this measurement value, the means of determining inheritance coefficients 8 determines the amount of change. Let the amount of change of the strip crown as determined by the means of determining inheritance coefficients 8 at this stage be $\Delta C_j$.

During pass (j+1), the portion of the strip 2 whereof the crown has been changed as a result of the abovementioned modification to the variables of the work roll bending apparatus 5 is rolled further. In this case, the work roll bending apparatus is not manipulated. The crown of the strip 2 on the delivery side of the rolling mill 1 is measured by the strip crown meter 6 if pass (j+1) is in the forward direction, and by the strip crown meter 7 if it is in the reverse direction. On the basis of this measurement value, the means of determining inheritance coefficients 8 determines the amount of change. Let this be called $\Delta C_{j+1}$.

Using these values, the means of determining inheritance coefficients 8 determines the inheritance coefficient $\eta_{j+1}$ of pass (j+1) according to the following expression.

$$\eta_{j+1} = \frac{\Delta C_{j+1}}{\Delta C_j} \tag{4}$$

The above description is the first characteristic of the present invention.

Figure 3:
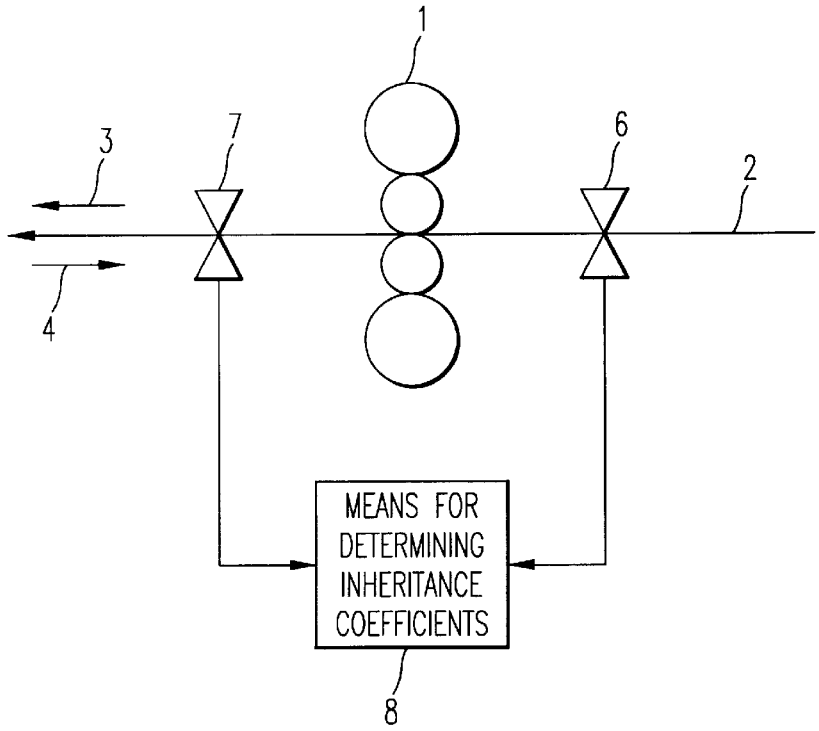
FIG. 3 is a drawing illustrating the outline configuration of a second embodiment of the present invention to which the invention pertains, along with the rolling mill to which it is applied.

There follows an explanation of the action of the second embodiment of the present invention. FIG. 3 is a schematic drawing illustrating the configuration of the second embodiment of the present invention pertains, along with the single-stand rolling mill to which it is applied. The configuration of the second embodiment is the same as that of the first embodiment without the work roll bending apparatus. As with the first embodiment, the rolling mill 1 may be equipped with a work roll bending apparatus. However, the second embodiment can be applied where the rolling mill is not equipped with a work roll bending apparatus, or where for some reason it is not operational.

The crown of the strip 2 before rolling is measured by the the strip crown meter 6 (during rolling in the forward direction; the strip crown meter 7 during rolling in the forward direction) on the entry side of the rolling mill 1. When this point reaches the strip crown meter 7 (during rolling in the forward direction; the strip crown meter 6 during rolling in the reverse direction) on the delivery side of the rolling mill 1, the crown of the strip 2 after rolling is measured, and both measurement values are transmitted to the means of determining inheritance coefficients 8. Let the crown on the entry side be called $C_j$, and that on the delivery side $C_{j+1}$. Using these values, the means of determining inheritance coefficients 8 determines the inheritance coefficient $\eta_{j+1}$ of pass (j+1) according to the following expression.

$$\eta_{j+1} = \frac{C_{j+1}}{C_j} \tag{5}$$

The above description is the second characteristic of the present invention.

Figure 4:
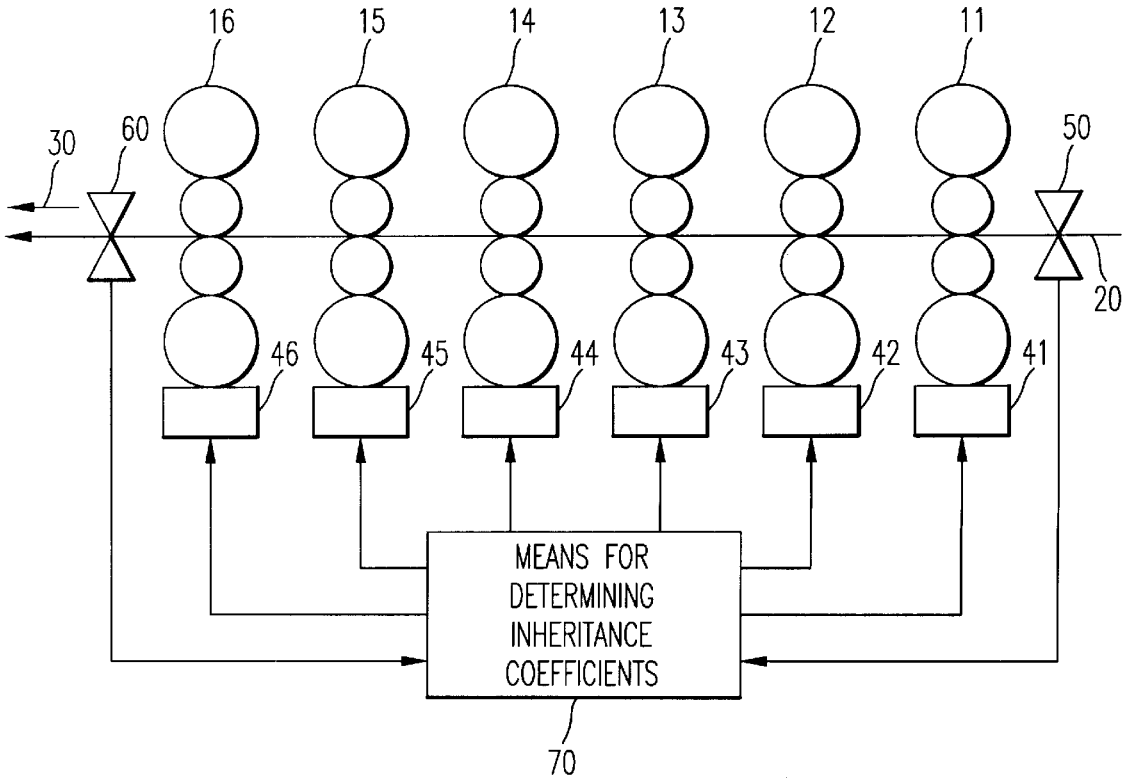
FIG. 4 is a drawing designed to illustrate the outline configuration of a third embodiment of the present invention to which the invention pertains, along with the rolling mill to which it is applied.

FIG. 4 is a schematic drawing illustrating the configuration of the third embodiment of the present invention pertains, along with the continuous rolling mill to which it is applied. The number of rolling mills may be two or any number in excess of that, and the explanation which follows assumes that there are six stands. In FIG. 4, the configuration is such that the rolling mills are arranged in a six-stand tandem system from the first stand 11 to the sixth stand 16, the strip 20 being rolled in the direction of the arrow 30. Each rolling mill is equipped with a work roll bending apparatus 41–46. In addition, there is a strip crown meter 50 on the entry side of the first stand 11, and another strip crown meter 60 on the delivery side of the sixth stand 16. A means of determining inheritance coefficients 70 manipulates the variable amount of the work roll bending apparatus 41–46, and determines the inheritance coefficients in accordance with the measurement values of the crown of the strip 20 as measured by the strip crown meters 50, 60.

In the third embodiment, the relationship between the variable amount of the work roll bending apparatus and the strip crown is represented by the following expression.

$$\Delta C_{j+1} = \frac{\partial C_{j+1}}{\partial C_j} \cdot \Delta C_j + \frac{\partial C_{j+1}}{\partial F_{j+1}} \cdot \Delta F_{j+1} \tag{6}$$

where $\Delta C_{i+1}$: Amount of change of the strip crown on the delivery side of the (i+1) stand $\partial C_{i+1}/\partial C_i$: Inheritance coefficient of the (i+1) stand ($=\eta_{i+1}$)

$\Delta C_i$: Amount of change of the strip crown on the entry side of the (i+1) stand $\partial C_{i+1}/\partial F_{i+1}$: Influence coefficient on the strip crown in relation to the variables of the work roll bending apparatus of the (i+1) stand $\Delta F_{i+1}$: Amount of modification to the variables of the work roll bending apparatus of the first (i+1) stand The above description is the third characteristic of the present invention.

There follows an explanation of the action of the third embodiment of the present invention with reference to FIG. 4. First of all, during the course of rolling the strip 20 the means of determining inheritance coefficients 70 changes by $\Delta F_6$ the variables of the work roll bending apparatus 46 of the sixth stand 16. As a result, the crown of the strip 20 on the delivery side of the sixth stand 16 is changed, and this is measured by the strip crown meter 60. On the basis of this measurement value, the means of determining inheritance coefficients 70 determines the amount of change $\Delta C_{66}$ of the crown of the strip 20. If the amount of change $\Delta F_6$ to the variables of the work roll bending apparatus 46 of the sixth stand 16, and the amount of change $\Delta C_{66}$ of the strip crown are applied to expression (6), the resulting expression is $$\Delta C_{66} = \frac{\partial C_6}{\partial F_6} \cdot \Delta F_6 \tag{7}$$

Thus, the means of determining inheritance coefficients 70 calculates the influence coefficient on the strip crown in relation to the variables of the work roll bending apparatus by means of the expression $$\frac{\partial C_6}{\partial F_6} = \frac{\Delta C_{66}}{\Delta F_6} \tag{8}$$

Meanwhile, the means of determining inheritance coefficients 70 calculates the influence coefficient on the strip crown in relation to the variables of the work roll bending apparatus on each stand. And so that calculates the correction coefficient K from the calculation value and expression (8) as $$K = \frac{\dfrac{\partial C_6}{\partial F_6}}{\left(\dfrac{\partial C_6}{\partial F_6}\right)_{CAL}} \tag{9}$$

Next, the means of determining inheritance coefficients 70 changes by $\Delta F_5$ the variables of the work roll bending apparatus 45 of the fifth stand 15. As a result, the crown of the strip 20 on the delivery side of the fifth stand 15 is changed, and the crown of the strip 20 on the delivery side of the sixth stand 16 also is changed accordingly. This is measured by the strip crown meter 60, and on the basis of this the means of determining inheritance coefficients 70 determines the amount of change $\Delta C_{65}$ of the crown of the strip 20.

Applying to expression (6) the amount of change $\Delta F_5$ to the variables of the work roll bending apparatus 45 of the fifth stand 15 and the calculation value of the influence coefficient on the strip crown in relation to the variables of the work roll bending apparatus 45 of the fifth stand 15 allows the amount of change $\Delta C_{55}$ of the crown of the strip 20 on the delivery side of the fifth stand 15 to be calculated as $$\Delta C_{55} = \left(\frac{\partial C_5}{\partial F_5}\right)_{CAL} \cdot \Delta F_5 \tag{10}$$

In addition, the correction coefficient determined according to expression (9) is applied to yield $$\Delta C_{55} = \left(\frac{\partial C_5}{\partial F_5}\right)_{CAL} \cdot K \cdot \Delta F_5 \tag{11}$$

Thus, by correcting the influence coefficient on the strip crown in relation to the variables of the work roll bending apparatus as calculated by the means of determining inheritance coefficients 70, it is possible to improve the accuracy of the amount of change $\Delta C_{55}$ of the crown of the strip 20 on the delivery side of the fifth stand 15. This is the fourth characteristic of the present invention.

As has been explained above, the amount of change of the crown of the strip 20 on the delivery side of the sixth stand 16 when the variables of the work roll bending apparatus 45 of the fifth stand 15 have been changed is $\Delta C_{65}$. This may be applied to expression (6) along with $\Delta C_{55}$ determined by means of expression (11) to yield $$\Delta C_{65} = \frac{\partial C_6}{\partial C_5} \cdot \Delta C_{55} \tag{12}$$

Thus, the means of determining inheritance coefficients 70 determines the inheritance coefficients $\eta_6$ of the sixth stand 16 as $$\eta_6 = \frac{\partial C_6}{\partial C_5} = \frac{\Delta C_{65}}{\Delta C_{55}} \tag{13}$$

The above description is the fifth characteristic of the present invention.

Next, the means of determining inheritance coefficients 70 changes by $\Delta F_4$ the variables of the work roll bending apparatus 44 of the fourth stand 14. As a result, the crown of the strip 20 on the delivery sides of the fourth stand 14, the fifth stand 15 and the sixth stand 16 are successively changed. The crown of the strip 20 on the delivery side of the sixth stand 16 is measured by the strip crown meter 60, on the basis of which the means of determining inheritance coefficients 70 determines the amount of change $\Delta C_{64}$ of the crown of the strip 20.

Applying to expression (6) the amount of change $\Delta F_4$ to the variables of the work roll bending apparatus 44 of the fourth stand 14 and the calculation value of the influence coefficient on the strip crown in relation to the variables of the work roll bending apparatus 44 of the fourth stand 14 in the same manner as with the fifth stand 15 allows the amount of change $\Delta C_{44}$ of crown of the strip 20 on the delivery side of the fourth stand 14 to be calculated as $$\Delta C_{44} = \left(\frac{\partial C_4}{\partial F_4}\right)_{CAL} \cdot \Delta F_4 \tag{14}$$

In addition, the correction coefficient determined according to expression (9) is applied to yield $$\Delta C_{44} = \left(\frac{\partial C_4}{\partial F_4}\right)_{CAL} \cdot K \cdot \Delta F_4 \tag{15}$$

Moreover, since according to expression (6)

$$\Delta C_{54} = \frac{\partial C_5}{\partial C_4} \cdot \Delta C_{44} \tag{16}$$

And $$\Delta C_{64} = \frac{\partial C_6}{\partial C_4} \cdot \Delta C_{54} \tag{17}$$

Expressions (16) and (17) yield $$\Delta C_{64} = \frac{\partial C_6}{\partial C_5} \cdot \frac{\partial C_5}{\partial C_4} \Delta C_{44} \tag{18}$$

Now, the amount of change $\Delta C_{64}$ of the crown of the strip 20 on the delivery side of the sixth stand 16 when the variables of the work roll bending apparatus 44 of the fourth stand 14 were changed is a known quanitity, as are the inheritance coefficient $\eta_6$ of the sixth stand 16, and the amount of change $\Delta C_{44}$ of the crown of the strip 20 on the delivery side of the fourth stand 14. Thus, the means of determining inheritance coefficients 70 determines the inheritance coefficient $\eta_5$ of the fifth stand 15 as $$\eta_5 = \frac{\partial C_5}{\partial C_4} = \frac{\Delta C_{64}}{\left(\frac{\partial C_6}{\partial C_5}\right) \cdot \Delta C_{44}} \tag{19}$$

Similar successive change of the variables of the work roll bending apparatus with which the third stand 13, second stand 12 and first stand 11 are equipped makes it possible to determine the inheritance coefficients $\eta_i$ of the fourth stand 14, third stand 13 and second stand 12 during rolling. Determining the inheritance coefficients $\eta_i$ in this manner is the sixth characteristic of the present invention.

Finally there remains the inheritance coefficient $\eta_1$ of the first stand 11, which cannot be determined in the abovementioned manner. Instead, the crown of the strip 20 is measured by the strip crown meter 50 on the entry side of the first stand 11. Using this measurement value, the means of determining inheritance coefficients 70 determines the inheritance coefficient $\eta_1$ of the first stand 11 by the same method as above. The above description is the seventh characteristic of the present invention.

It should be added that the foregoing description of the preferred embodiments of the present invention has assumed a four-high rolling mill, but the present invention can be applied to two, four, six, twelve, twenty or any number of rollers. Moreover, a work roll bending apparatus has been used to control the strip crown, but the present invention is in no way restricted to this. In other words, it can be implemented in the same manner using an intermediate roll bending apparatus, pair cross angle apparatus, CVC (continuous variable crown) roll shift apparatus, tapered roll shift apparatus, intermediate roll shift apparatus, work roll shift apparatus or similar equipment in place of the work roll bending apparatus.

The present invention makes it possible to determine the inheritance coefficient of the strip crown with a high degree of accuracy, and through the application of this makes it possible to improve accuracy of control of the strip crown when modifying the initial setting and variables of the apparatus which controls the strip crown.

Obviously, numerous additional modifications and variations to the present invention are possible in the light of the above teachings. It is therefore to be understood that within the scope of the appended claims the present invention may be practiced otherwise than as specifically described herein.

What is claimed is:

1. An apparatus for controlling a rolling mill based on a strip crown of a strip, comprising:

a first strip crown meter configured to measure the strip crown on an entry side of the rolling mill;

a second strip crown meter configured to measure the strip crown on a delivery side of the rolling mill; and determination means for changing variables to control the strip crown at least first and second times, and for determining an inheritance coefficient of the strip crown based on an amount of change in the crown as determined by measured values by the first and second strip crown meters before and after changing the variables the at least first and second times, and based on the variables changed the at least first and second times.

2. An apparatus for controlling a rolling mill based on a strip crown of a strip according to claim 1, wherein:

the strip crown is changed during rolling by changing the variables by the determination means, and further the inheritance coefficient is determined based on a first difference between the measured values on the entry side of the rolling mill by the first strip crown meter before and after changing the variables the at least first and second times, a second difference between the measured values on the delivery side of the rolling mill by the second strip crown meter before and after changing the variables the at least first and second times, and a third difference between the variables before and after being changed the at least first and second times.

3. An apparatus for controlling a continuous rolling mill system having two or more rolling mills based on a strip crown of a strip, comprising:

a first strip crown meter configured to measure the strip crown on an entry side of the rolling mill;

a second strip crown meter configured to measure the strip crown on a delivery side of the rolling mill; and determination means for changing variables to control the strip crown at least first and second times, and for determining an inheritance coefficient of the strip crown based on measured values of an amount of change in the crown by the first and second strip crown meters before and after changing the variables the at least two times.

4. An apparatus for controlling a continuous rolling mill system having two or more rolling mills based on a strip crown of a strip according to claim 3, wherein:

the determination means calculates a value of an influence coefficient on the strip crown, changes the variables the at least first and second times to control the strip crown of a final rolling mill during rolling, determines a measured value of the influence coefficient in relation to the variables to control the strip crown of the final rolling mill, and calculates a correction coefficient in accordance with the calculated influence coefficient and the measured value of the influence coefficient.

5. An apparatus for controlling a continuous rolling mill system having two or more rolling mills based on a strip crown of a strip according to claim 4, wherein:

the determination means changes the variables the at least first and second time to control the strip crown of a first rolling mill upstream from a final rolling mill, and determines an amount of change of the strip crown on the delivery side of the first rolling mill upstream from the final rolling mill in accordance with the changed variables, the calculated influence coefficient, and the correction coefficient.

6. An apparatus for controlling a continuous rolling mill system having two or more rolling mills based on a strip crown of a strip according to claim 5, wherein:

the determination means determines the inheritance coefficient of a final rolling mill based on an amount of change of the strip crown on the delivery side of the final rolling mill and an amount of change of the strip crown on the delivery side of a first rolling mill upstream from the final strip mill obtained by changing the variables the at least first and second times to control the strip crown of the first rolling mill upstream from the final rolling mill.

7. An apparatus for controlling a continuous rolling mill system having two or more rolling mills based on a strip crown of a strip according to claim 4, wherein:

the determination means changes the variables the at least first and second times to control the strip crown of an n-th rolling mill upstream from a final rolling mill, and determines an amount of change of the strip crown on a delivery side of the n-th rolling mill upstream from the final rolling mill in accordance with the changed variables, the calculated influence coefficient, and the correction coefficient.

8. An apparatus for controlling a continuous rolling mill system having two or more rolling mills based on a strip crown of a strip according to claim 7, wherein:

the determination means determines the inheritance coefficient of an (n−1)-th rolling mill based on an amount of change of the strip crown on a delivery side of a final rolling mill, an amount of change of the strip crown on a delivery side of an n-th rolling mill upstream from the final strip mill, and the inheritance coefficient from an (n−2)-th rolling mill upstream from the final rolling mill obtained by changing the variables the at least first and second times to control the strip crown of the n-th rolling mill upstream from the final rolling mill.

9. An apparatus for controlling a continuous rolling mill system having two or more rolling mills based on a strip crown of a strip according to claim 8, wherein:

the determination means determines an influence coefficient of the first rolling mill based on the strip crown measured by the first strip crown meter which is located on the entry side of the continuous rolling mill system and the strip crown measured when a measured part of the strip by the first strip crown meter which is located on the entry side of the continuous rolling mill system reaches the second strip crown meter which is located on the delivery side of the continuous rolling mill system.

* * * * *